US012006665B2

(12) United States Patent
Scriven et al.

(10) Patent No.: US 12,006,665 B2
(45) Date of Patent: Jun. 11, 2024

(54) LOCK ASSEMBLY FOR A WEAR ASSEMBLY

(71) Applicant: Bradken Resources Pty Limited, Mayfield West (AU)

(72) Inventors: Adam Scriven, Ashtonfield (AU); Hayden Buchanan, Fletcher (AU); William Elphinstone, Warners Bay (AU)

(73) Assignee: Bradken Resources Pty Limited, Mayfield West (AU)

( * ) Notice: Subject to any disclaimer, the term of this patent is extended or adjusted under 35 U.S.C. 154(b) by 736 days.

(21) Appl. No.: 17/255,854

(22) PCT Filed: Jun. 29, 2018

(86) PCT No.: PCT/AU2018/050674
§ 371 (c)(1),
(2) Date: Dec. 23, 2020

(87) PCT Pub. No.: WO2020/000013
PCT Pub. Date: Jan. 2, 2020

(65) Prior Publication Data

US 2021/0262206 A1 Aug. 26, 2021

(51) Int. Cl.
*E02F 9/28* (2006.01)

(52) U.S. Cl.
CPC ..... *E02F 9/2833* (2013.01); *E02F 9/285* (2013.01)

(58) Field of Classification Search
CPC ..... E02F 9/2833; E02F 9/2841; E02F 9/285; E02F 9/2816; E02F 9/2858; E02F 9/2825; E02F 9/28
See application file for complete search history.

(56) References Cited

U.S. PATENT DOCUMENTS

| | | | | |
|---|---|---|---|---|
| 3,448,652 | A | 6/1969 | Rhoads | |
| 8,495,826 | B2 | 7/2013 | Itou et al. | |
| 9,009,995 | B2 * | 4/2015 | Freund | E02F 9/2825 37/456 |
| 9,540,795 | B2 * | 1/2017 | Freund | E02F 9/2883 |
| 9,702,122 | B2 * | 7/2017 | Hurley | E02F 9/2833 |
| 9,874,002 | B2 * | 1/2018 | Lombardo | E02F 9/2841 |
| 2007/0261278 | A1 | 11/2007 | Campomanes | |
| 2012/0051836 | A1 | 3/2012 | Jakubisin | |

FOREIGN PATENT DOCUMENTS

EP 2952639 A1 * 12/2015 ..... E02F 9/28

OTHER PUBLICATIONS

International Search Report and Written Opinion dated Sep. 26, 2018, directed to PCT/AU2018/050674; 11 pages.

* cited by examiner

*Primary Examiner* — Adam J Behrens
*Assistant Examiner* — Blake E Scoville
(74) *Attorney, Agent, or Firm* — Morrison & Foerster LLP

(57) ABSTRACT

A locking assembly is disclosed for securing a wear member to a support structure. The locking assembly includes a locking pin having a pin capable of securing the wear member to the support structure. The pin is disclosed as including pin portions that are interconnected through a coupling to allow torque to be transferred from at least one pin portion to the other pin portion and allow axial movement of one of the pin portions relative to the other pin portion in the direction of the pin axis. Also disclosed is a locking assembly to retain a pin in a predetermined position.

19 Claims, 15 Drawing Sheets

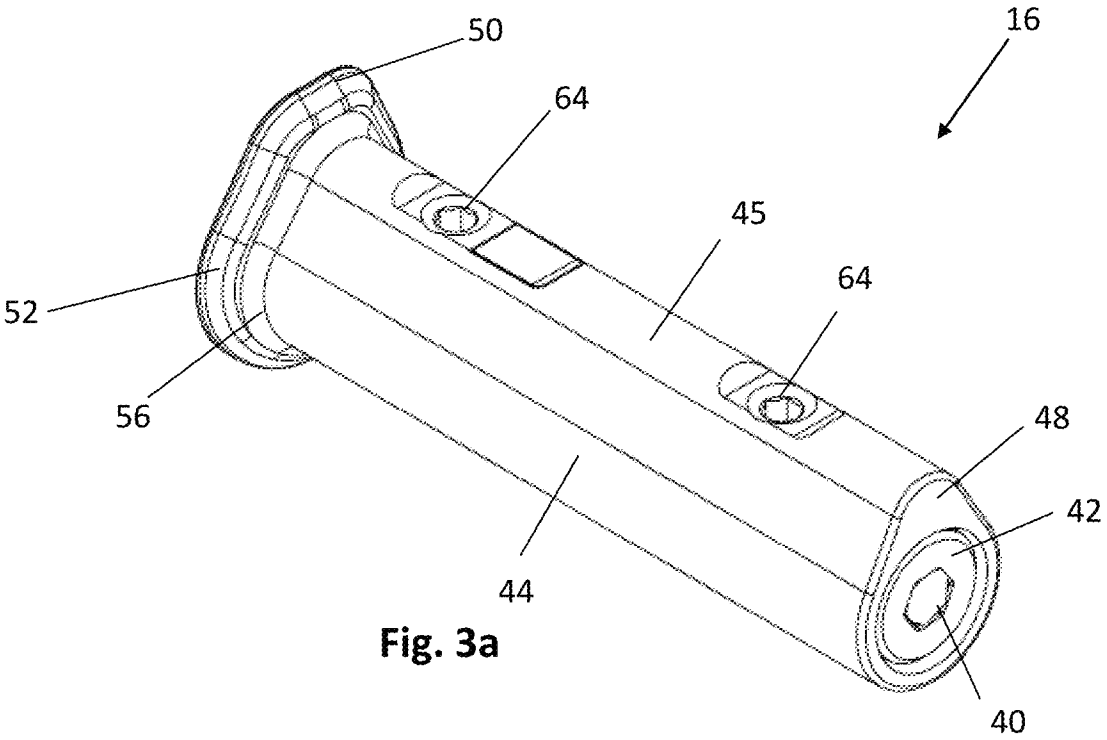
Fig. 3a
Fig. 3b
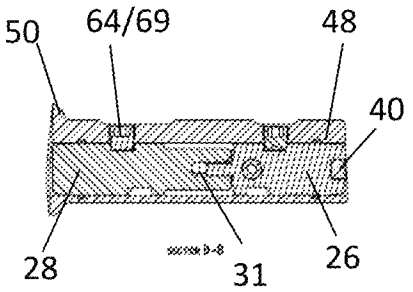
Fig. 3c
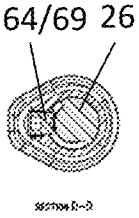
Fig. 3d
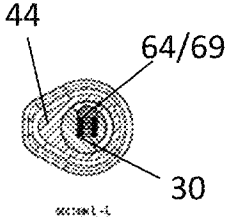
Fig. 3e

LOCK ASSEMBLY FOR A WEAR ASSEMBLY

CROSS-REFERENCE TO RELATED APPLICATIONS

This application is a national stage application under 35 USC 371 of International Application No. PCT/AU2018/050674, filed Jun. 29, 2018, the entire contents of which are incorporated herein by reference.

FIELD OF THE DISCLOSURE

This disclosure relates to excavation wear assemblies, lock assemblies for use in such wear assemblies and to components of such excavation wear and lock assemblies. The disclosure has application in land based digging equipment and is herein described in that context. However, it is to be appreciated that the disclosure has broader application for example in waterborne excavation equipment such as dredgers, and is therefore not limited to that application.

BACKGROUND OF THE DISCLOSURE

Wear members are provided on the digging edge of various pieces of digging equipment such as the buckets of front end loaders. Each excavation wear assembly is formed of a number of parts, commonly a wear member, a support structure and a lock. The support structure is typically fitted to the excavation equipment and the wear member fits over the support system and is retained in place by the lock. In some instances, one or more intermediate parts may be also included between the wear member and the support structure. For ease of description it is to be understood that, unless the context requires otherwise, the term "support structure" used in this specification includes both the support structure arranged to be fitted to the excavation equipment or, if one or more intermediate parts are provided, to that intermediate part(s) or to the combination of the support structure and the intermediate part(s).

The reason that the excavation wear assembly is formed of a number of parts is to avoid having to discard the entire wear member when only parts of the wear member, in particular the ground engaging part of the excavation wear assembly (i.e. the wear member) is worn or broken.

Various types of locks, wear members and support structures are known. However, it is always desirable to design new excavation tooth assemblies and parts thereof.

It is to be understood that, if any prior art is referred to herein, such reference does not constitute an admission that the prior art forms a part of the common general knowledge in the art, in Australia or any other country.

SUMMARY OF THE DISCLOSURE

The present disclosure relates to improvements in relation to excavation wear assemblies, lock assemblies for use in such wear assemblies and to components of such excavation wear and lock assemblies adapted to engage with excavation equipment.

The present disclosure relates generally to locking assemblies and to excavation wear assemblies. In some embodiments, the wear member is secured to the support structure that is fixed to a bucket lip or other digging edge. The support structure may be part of an adapter or may be integrally formed to the digging edge. However, it is understood that embodiments of the present disclosure may be applied to excavation tooth assemblies in which the wear member is mounted to an intermediate member (which may also be referred to as a support structure or an adapter) that in turn is mounted to a nose that forms part of the digging edge or to the nose of a further support structure that is mounted to the digging edge. In the present disclosure, locking assemblies are used to secure the wear member to the support structure, however, the locking assemblies disclosed herein may also be used to secure any member that makes up the excavation wear assemblies to one another.

According to one aspect, disclosed is a locking assembly for securing a wear member to a support structure, the locking assembly comprising:

- a locking pin having a pin axis and comprising a first pin portion and a second pin portion that are spaced along the pin axis, the pin portions being interconnected through a coupling to allow torque to be transferred from at least one of the first or second pin portions to the other of the first or second pin portions and allow axial movement of one the pin portions relative to the other pin portion in the direction of the pin axis; and
- the coupling is in the form of complementary coupling elements that interfit and extend in the direction of the pin axis.

Advantageously, the coupling arrangement having interfitting coupling elements reduces contact pressure during the relative axial movement and torque transfer. This helps reduce jamming.

In some forms, the locking assembly may further comprise a housing having an internal passage which extends along a longitudinal axis between first and second ends. The pin may be locatable within the housing with at least one of the pin portions being rotatable about the longitudinal axis within the housing. In some forms, an external surface of the housing is non-circular to prevent rotation of the housing about its longitudinal axis relative to the excavation assembly once installed in a complementary passage in the excavation assembly.

In some forms, the coupling elements of the first and second pin portions may be angularly spaced apart about the pin axis. The coupling elements of the first pin portion may be arranged to be angularly offset from the coupling portions of the second pin portion so as to interfit with one another to form the coupling. In some forms, the or each pin portion may include two coupling elements that are angularly spaced apart by approximately 180°.

In some embodiments, the locking assembly may further comprise a transforming mechanism that causes relative axial movement of the pin portions on rotation of at least one of the pin portions. In some forms, both the first pin portion and the second pin portion may rotate together. In use, the coupling causes the first and second portions to rotate together. The transforming mechanism may comprise at least one cam and follower mechanism. The at least one cam may include a cam surface which is formed about at least one of the pin portions and the at least one follower is mounted to the housing and the follower remains in contact with the cam surface as the at least one pin portion rotates to cause the relative axial movement of the pin portions. The first and second pin portions each may include a cam and follower mechanism. In some forms, the cam surface includes a helical portion. The helical arrangement includes a pitch which corresponds to the number of rotations of the pin portions to establish the desired axial displacement. Varying the pitch of the helical portion may vary to vary the axial displacement. In alternative embodiments, the cam surface may include a threaded arrangement, or a J-slot capable of inducing the relative axial displacement of the pin portions.

In some forms, the pin portions may be axially movable between an extended position and a retracted position. In one form, in the extended position, the locking assembly secures the wear member to the support structure. In the retracted position, the wear member is removable from the support structure. When in the extended position, an end region of at least one of the pin portions may extend beyond at least one of the ends of the housing. When in the extended position, respective end regions of the pin portions may both extend beyond the ends of the housing. When in the retracted position, the at least one of the pin portions may be disposed within housing. When in the retracted position both pin portions are disposed within the housing.

In an embodiment, the locking assembly further comprises at least one retainer to retain the pin portions in a predetermined axial position. The predetermined position may be between the extended and the retracted position or beyond the extended position in relation to the ends of the housing. The retainer may include a keeper, and a latch member engageable with the keeper in a latched position to retain the pin portions in the predetermined axial position. In the predetermined position, the keeper latches the latch member in the latched position. The keeper may include a biasing member that is biased to the latched position and the latch member forms part of the at least one follower and wherein the biasing member is mounted along a portion of the cam surface such that as the at least one pin portion rotates the at least one follower remains in contact with the cam surface and moves the biasing member against its bias to allow the latch to move to the latched position, and when in the latched position, the keeper may engage with the latch member to retain the pin portions in the predetermined position. It is understood that alternatively the latch member may include the biasing member while the keeper is designed to retain the latch member in the latched position.

In some forms, the biasing member may include a resilient material that compresses to allow the follower to pass over or by the biasing member to the latched position. In some forms, the biasing member may include a spring such as a compression spring or a leaf spring.

In one embodiment, the predetermined position is the extended position.

According to a second aspect, disclosed is a locking assembly for securing a wear member to a support structure, the locking assembly comprising:

a locking pin having a pin axis and comprising a first pin portion and a second pin portion that are spaced along the pin axis, the pin portions being interconnected through a coupling to allow torque to be transferred from at least one of the first or second pin portions to the other of the first or second pin portions and allow axial movement of one of the pin portions relative to the other pin portion in the direction of the pin axis; and a transforming mechanism that causes relative axial movement of the pin portions on rotation of at least one of the pin portions wherein, in use, the coupling causes both the first pin portion and the second pin portion rotate together.

In some forms, the locking assembly may further comprise a housing having an internal passage which extends along a longitudinal axis between first and second ends; the locking pin being rotatably mounted within the housing. In some forms, an external surface of the housing is non-circular to prevent rotation of the housing about its longitudinal axis relative to the excavation assembly once installed in a complementary passage in the excavation assembly.

In some forms, the transforming mechanism may comprise at least one cam and follower mechanism. In some forms, the at least one cam includes a cam surface which is formed about at least one of the pin portions and at least one follower is mounted to the housing, and the follower remains in contact with the cam surface as the at least one pin portion rotates to cause the relative axial movement of the pin portions. In one embodiment, the first and second pin portions each may include a cam and follower mechanism. In some forms, the cam surface includes a helical portion which is advantageous as a helical arrangement reduces the number of rotations of the pin portions. In alternative embodiments, the cam surface may include a threaded arrangement, a J-slot, or ratchet mechanism capable of inducing the relative axial displacement of the pin portions.

In some embodiments, the pin portions may be axially movable between an extended position and a retracted position. In some forms, both the pin portions rotate together to the extended position. When in the extended position, an end region of at least one of the pin portions may extend beyond at least one of the ends of the housing. When in the extended position, respective end regions of the pin portions may both extend beyond the ends of the housing. When in the retracted position, the at least one of the pin portions may be disposed within housing. When in the retracted position, both pin portions may be disposed within the housing.

In some forms, the locking assembly further comprising at least one retainer to retain the pin portions in a predetermined position. The retainer may include a keeper and a latch member that is engageable with the keeper in a latched position wherein the pin portions are retained in the predetermined position.

The keeper may include a biasing member that is biased to the latched position and the latch member forms part of the at least one follower and wherein the biasing member is mounted along a portion of the cam surface such that as the at least one pin portion rotates the at least one follower remains in contact with the cam surface and moves the biasing member the against its bias to allow the latch to move to the latched position, and when in the latched position, the keeper engages with the latch member to retain the pin portions in the predetermined position.

In some forms, the predetermined position is the extended position. In some forms, the predetermined position is between the extended and the retracted position. In some forms, in the predetermined position, the ends of the pin portions extend beyond the extended position.

According to a third aspect, disclosed is an excavation wear assembly for attachment of a wear member to a support structure, the excavation wear assembly comprising:

the support structure having a nose portion which is configured to receive a socket of the wear member;

a locking space formed in the support structure arranged to receive a locking assembly;

the locking assembly comprising:

a locking pin having a pin axis and comprising a first pin portion and a second pin portion that are spaced along the pin axis, the pin portions being interconnected through a coupling to allow torque to be transferred from at least one of the first or second pin portions to the other of the first or second pin portions and allow axial movement of one of the pin portions relative to the other pin portion in the direction of the pin axis;

wherein the coupling is in the form of complementary elements that interfit and extend in the direction of the pin axis, wherein the relative axial movement of the pin portions in the direction of the pin axis are configured to secure the wear member to the support structure.

In some forms, the locking assembly further comprises a housing locatable in the locking space of the support structure, the housing having an internal passage which extends along a longitudinal axis between first and second ends; and the pin locatable within the housing, wherein at least one of the pin portions is rotatable within the housing. In some forms, the housing includes an external surface that is non-circular to prevent the housing being rotatable about its longitudinal axis relative to the excavation wear assembly once installed in a complementary passage in the excavation assembly.

In some forms, the pin portions may be axially movable between an extended position and a retracted position.

In some forms, the excavation wear assembly may further comprise the wear member. The wear member may have at least one retaining surface, and when the wear member is mounted to the support structure, the retaining surface is arranged to be aligned with the locking space of the support structure such that when the pin is in the extended position, the wear member is secured to the support structure, and when the pin is in the retracted position, the wear member is releaseable from the support structure.

When the wear member is mounted to the support structure and when the pin is in the extended position, an end region of at least one of the pin portions extends beyond at least one of the ends of the housing and into engagement with the at least one retaining surface of the wear member to secure the wear member to the support structure.

When the pin is in the extended position, respective end regions of the pin portions both extend beyond the ends of the housing and into engagement with respective retaining surfaces of the wear member.

When the pin is in the retracted position, the at least one of the pin portions is disposed within housing and disengaged from the at least one retaining surface of the wear member to allow the wear member to be removed from the support structure. When the pin is in the retracted position, both pin portions may be disposed within the housing and disengaged from the respective retaining surfaces of the wear member.

In some forms, the locking assembly further comprises a transforming mechanism that causes the relative axial movement of the pin portions on rotation of at least one of the pin portions wherein, in use, the coupling causes both the first pin portion and the second pin portion rotate together. In some forms, the transforming mechanism includes at least one cam and follower mechanism.

According to a fourth aspect, disclosed is an excavation wear assembly for attachment of a wear member to a support structure to a digging edge, the excavation wear assembly comprising:

the support structure having a nose portion which is configured to receive a socket of the wear member;

a locking space formed in the support structure arranged to receive a locking assembly;

the locking assembly comprising:

a locking pin having a pin axis and comprising a first pin portion and a second pin portion that are spaced along the pin axis, the pin portions being interconnected through a coupling to allow torque to be transferred from at least one of the first or second pin portions to the other of the first or second pin portions and allow axial movement of one of the pin portions relative to the other pin portion in the direction of the pin axis; and a transforming mechanism that causes relative axial movement of the pin portions on rotation of at least one of the pin portions wherein, in use, the coupling causes both the first pin portion and the second pin portion rotate together, wherein the relative axial movement of the pin portions in the direction of the pin axis are configured to secure the wear member to the support structure.

In some forms, the locking assembly further comprises a housing locatable in the locking space of the support structure, the housing having an internal passage which extends along a longitudinal axis between first and second ends; and the pin locatable within the housing, wherein at least one of the pin portions is rotatable within the housing. In some forms, the housing includes an external surface that is non-circular to prevent the housing being rotatable about its longitudinal axis relative to the excavation wear assembly.

In some forms, the pin portions are axially movable between an extended position and a retracted position.

In some forms, the excavation wear assembly further comprising the wear member, the wear member having at least one retaining surface, and when the wear member is mounted to the support structure, the retaining surface is arranged to be aligned with the locking space of the support structure such that when the pin is in the extended position, the wear member is secured to the support structure, and when the pin is in the retracted position, the wear member is releaseable from the support structure When the wear member is mounted to the support structure and when the pin is in the extended position, an end region of at least one of the pin portions may extends beyond at least one of the ends of the housing and into engagement with the at least one retaining surface of the wear member to secure the wear member to the support structure.

When the pin is in the extended position, respective end regions of the pin portions may both extend beyond the ends of the housing and into engagement with respective retaining surfaces of the wear member.

When the pin is in the retracted position, the at least one of the pin portions is disposed within housing and disengaged from the at least one retaining surface of the wear member to allow the wear member to be removed from the support structure. When the pin is in the retracted position, both pin portions are disposed within the housing and disengaged from the respective retaining surfaces of the wear member.

In some forms, the coupling of the locking assembly may be in the form of complementary elements that interfit and extend in the direction of the pin axis.

According to a fifth aspect, disclosed is A locking assembly for securing a wear member to a support structure, the locking assembly comprising: a locking pin; a housing having an internal passage in which the pin is located, the locking pin being movable within the housing to a predetermined position; and at least one retainer to retain the pin in the predetermined position, wherein the retainer including a keeper and a latch member engageable with the keeper on movement of the pin to the predetermined position, the latch member comprises a c-shaped member having opposing arms that are caused to resiliently deform on engagement with the keeper.

In some forms, the c-shaped member is disposed in the pin and the keeper is disposed in the housing.

In some forms, the locking pin is caused to rotate within the housing about a pin axis to the predetermined position.

In some forms, rotation of the pin causes axial movement of the pin. In this arrangement, the locking assembly may further comprise a transforming mechanism that causes the relative axial movement of the pin on rotation of the pin.

In some forms, the transforming mechanism comprises at least one cam and follower mechanism. In a particular form, the at least one cam includes a cam surface which is formed about the pin and the at least one follower is mounted to the housing and the follower remains in contact with the cam surface as the at least one pin rotates to cause relative axial movement of the pin.

In some forms, the keeper forms part of the at least one follower and wherein the latch member is mounted along a portion of the cam surface such that as the pin rotates the at least one follower remains in contact with the cam surface and moves the arms of c-shaped member against its bias to allow the c-shaped member to move past, or into contact with, the keeper so that the pin is able to move to the predetermined position, whereafter the c-shaped member is able to move under its bias back towards its natural position into a latched position, and when in the latched position, the keeper engages with the c-shaped member to retain the pin in the predetermined position.

In some forms, the c-shaped member is in the form of a spring clip. In a particular arrangement, the c-shaped member may be disposed in a recess in the pin and be captured in the recess.

In some forms, of the fifth aspect, the predetermined position is an extended position of the pin.

In some forms, the locking pin has a pin axis may comprise a first pin portion and a second pin portion that are spaced along the pin axis, the pin portions being interconnected through a coupling to allow torque to be transferred from at least one of the first or second pin portions to the other of the first or second pin portions and allow relative axial movement of the pin portions in the direction of the pin axis.

The locking assembly or the excavation wear assembly according to any one of the preceding aspects further comprising a drive arrangement provided on the end of at least one of the pin portions to cause rotation of the pin.

BRIEF DESCRIPTION OF THE FIGURES

Embodiments will now be described by way of example only, with reference to the accompanying drawings in which

FIG. 3*a* is an isometric view of the locking assembly as shown in FIG. 2 in a retracted position;

FIG. 3*b* is a side view of the locking assembly as shown in FIG. 3*a;*

FIG. 3*c* is a cross-sectional view of the section B-B of the locking assembly as shown in FIG. 3*b;*

FIG. 3*d* is a cross-sectional view of the section D-D of the locking assembly as shown in FIG. 3*b;*

FIG. 3*e* is a cross-sectional view of the section L-L of the locking assembly as shown in FIG. 3*b;*

DETAILED DESCRIPTION OF THE DISCLOSURE

Figure 1:
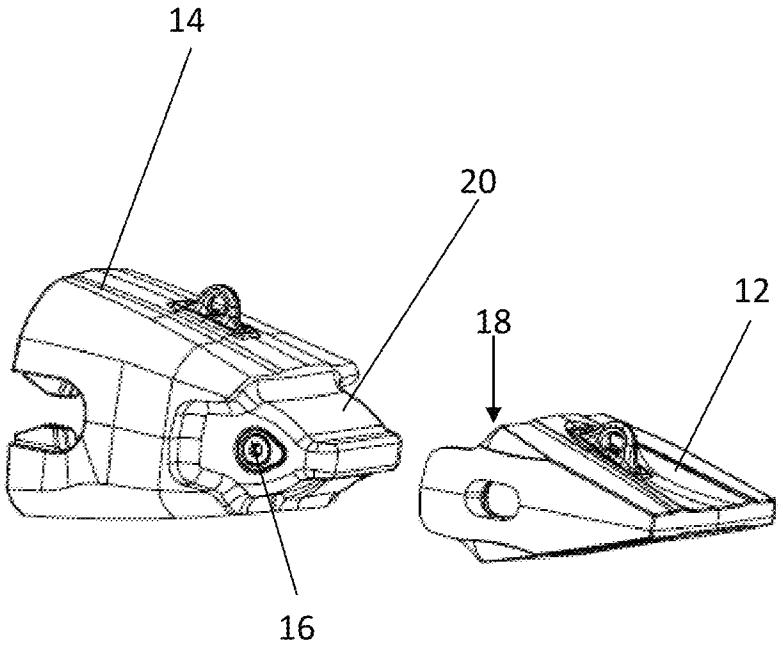
FIG. 1 is a perspective view of an embodiment of an excavation wear assembly.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

The present disclosure relates generally to excavation wear assemblies for digging equipment. In the illustrated embodiment, an excavation wear assembly is shown comprising a wear member that is mounted to a nose portion of a support structure that is fixed to a bucket lip or other digging edge. The nose portion may be part of the support structure or may be integrally formed to the digging edge. However, it is to be understood that embodiments of the present disclosure could be applied to excavation wear assemblies in which the wear member is mounted to an intermediate member (which may also be referred to as a support structure) that in turn is mounted to a nose that forms part of the digging edge or to the nose of a further tooth member that is mounted to the digging edge. In the excavation wear assemblies of the present disclosure, a lock is used to lock the wear member to the nose of the support structure or the nose integrally formed with the digging edge. Similarly, in excavation wear assemblies comprising an intermediate member, locks are used to lock the point to the intermediate member and the intermediate member to the nose formed with the digging edge or of the tooth member attached to the digging edge.

Referring to FIGS. 1 to 6, there is shown an excavation wear assembly 10, comprising a wear member 12, a support structure 14 and a locking assembly 16. The wear member 12 has a socket 18, and the support structure 14 has a nose portion 20. The locking assembly 16 as shown in FIG. 1 is inserted into a locking space 22 formed in the support structure 14 prior to mounting the wear member 12 to the support structure 14. The socket 18 of the wear member 12 is configured to receive the nose portion 20 of the support structure 14 when the wear member 12 and the support structure 14 are brought together as shown in FIGS. 5 and 6. In the illustrated embodiment, the support structure 14 is attached to a digging edge of excavation equipment, and the wear member 12 includes the wear surface and edge which does the digging.

Figure 2:
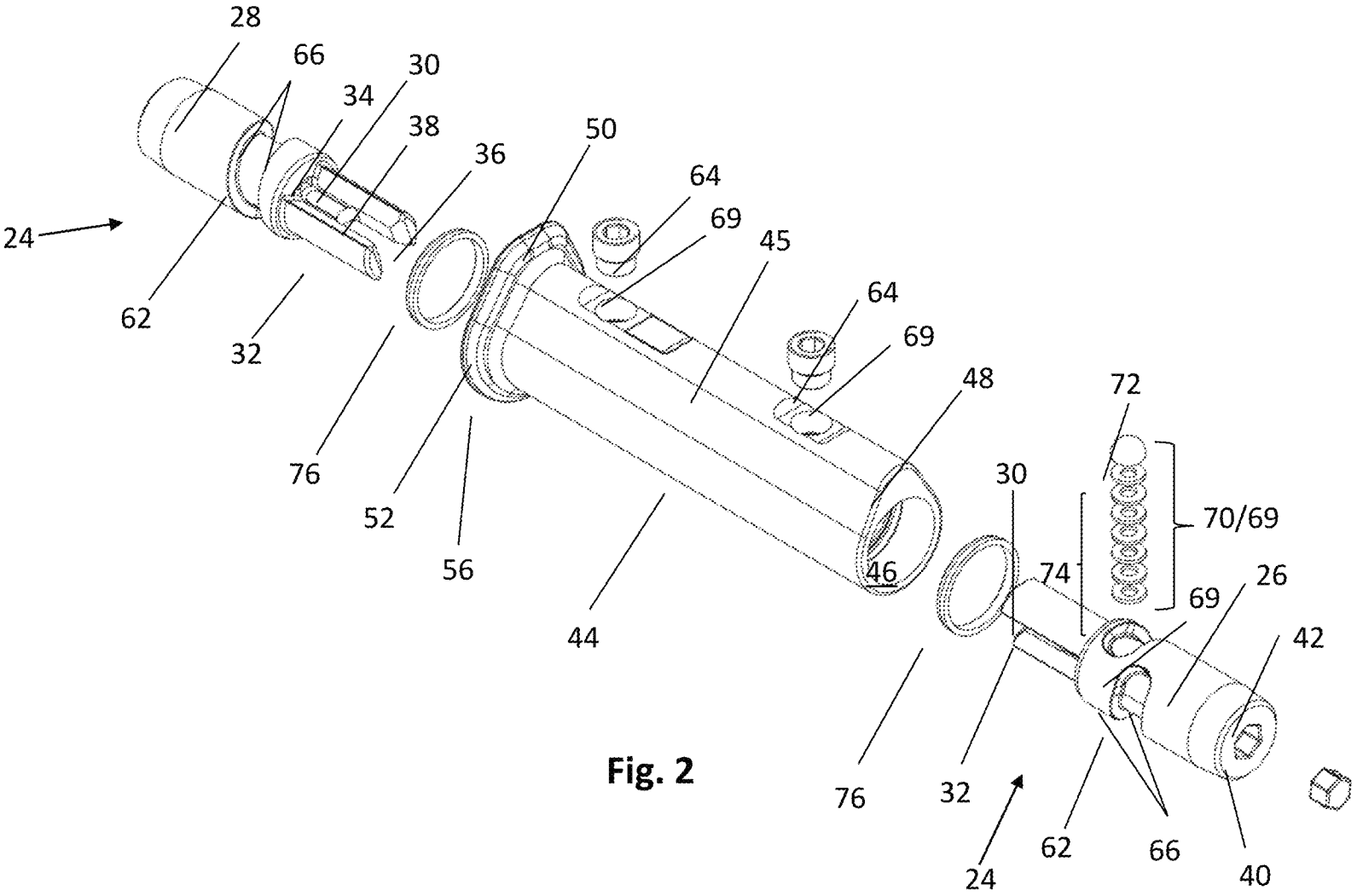
FIG. 2 is an exploded isometric view of an embodiment of a locking assembly for the excavation wear assembly of FIG. 1.
Figure 4A:
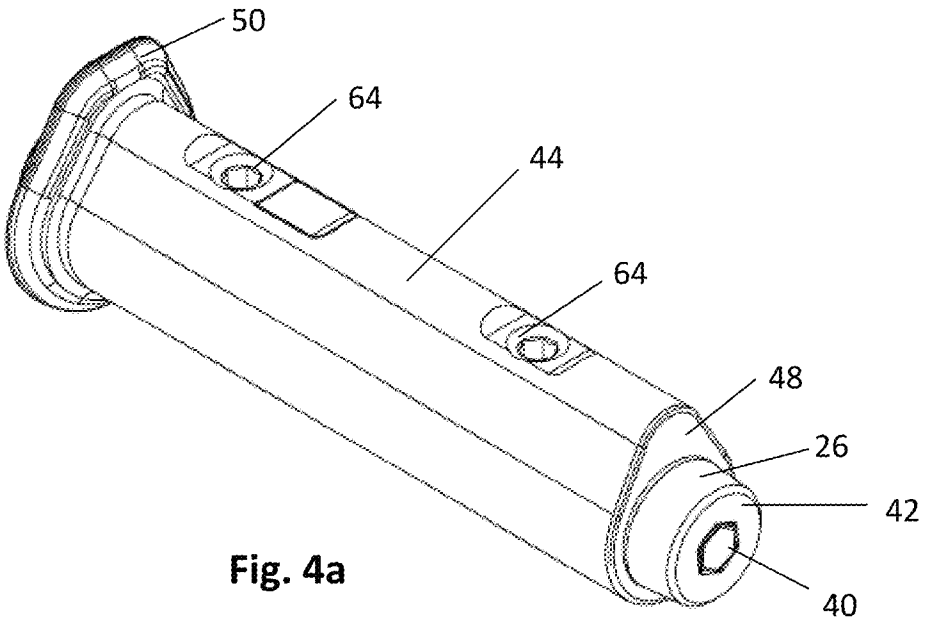
FIG. 4*a* is an isometric view of the locking assembly as shown in FIG. 3 in an extended position.
Figure 4B:
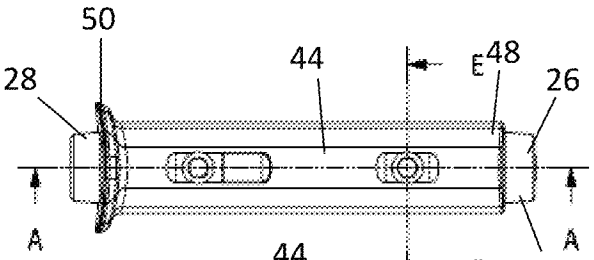
FIG. 4*b* is a side view of the locking assembly as shown in FIG. 4*a;*
Figure 4D:
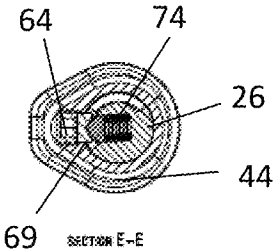
FIG. 4*d* is a cross-sectional view of the section E-E of the locking assembly as shown in FIG. 4*b;*
Figure 4C:
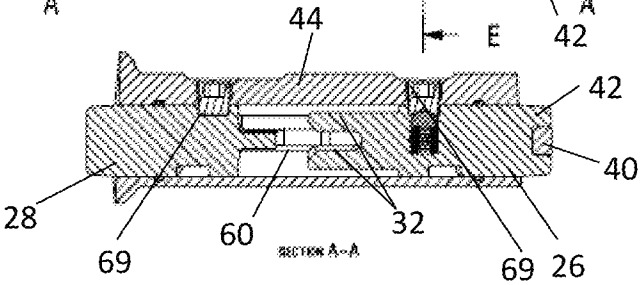
FIG. 4*c* is a cross-sectional view of the section A-A of the locking assembly as shown in FIG. 4*b;*

As shown in FIGS. 2, 3 and 4, the locking assembly 16 is arranged and designed to secure the wear member 12 to the support structure 14. The locking assembly 16 includes a locking pin 24 that extends along a pin axis and includes a first pin portion 26 and a second pin portion 28 that are spaced along the pin axis. The pin portions 26, 28 are interconnected through a coupling 30 that allow torque to be transferred from at least one of the pin portions to the other of the pin portions. The coupling 30 also allows axial movement of one of the pin portions 26, 28 relative to the other pin portion in the direction of the pin axis.

The coupling 30 includes complementary coupling elements 32 that interfit and extend in the direction of the pin axis. The coupling elements 32 of the first pin portion are angularly offset from the coupling elements 32 of the second pin portion so they interfit with one another. In the illustrated embodiment, the coupling elements 32 are in the form of fingers or splines that are angularly spaced apart about the pin axis. Together, the coupling elements 32 form the coupling 30 which is cylindrical in shape. The first pin portion 26 includes two coupling elements 32 that are angularly spaced apart by approximately 180°. As a result, the two coupling elements 32 are opposing one another. It is to be appreciated that different configurations of coupling elements are contemplated which may include more than two coupling elements on each pin portion.

Each coupling element 32 extends between a first end 34 and a second end 36 and includes radially extending inclined side surfaces 38. The side surfaces 38 are in contact to bear against one another to transfer torque between one pin portion to the other pin portion. Depending on the direction of the torque applied to the one pin portion, the side surfaces 38 that bear against one another will vary. Torque is applied to an end 42 of one of the pin portions, which then rotate about the pin axis in either a clockwise or a counter-clockwise direction. This arrangement disperses the forces across the side surfaces to prevent jamming of the pin portions during rotation.

In the illustrated embodiment, a drive arrangement 40 in the form of a hexagonal recess 40 is provided in the end 42 of the first pin portion to enable an operator to cause rotation of the locking pin 24 as required. This is carried out by the operator inserting an appropriately shaped tool into the recess 40. The manner in which the locking pin 24 is inserted into the locking space 22, means that after it has been inserted, the hexagonal recess 40 remains exposed at the end of the locking space 16. This allows for easy access to the recess 40 for access to the drive arrangement 40 and for removal of the locking pin 24 from the locking space 22 when required.

The locking assembly further includes a housing 44. The housing 44 includes a body 45 that includes a hollow passage 46 that extends along a longitudinal axis between first 48 and second 50 ends. The locking pin 24 is locatable within the housing 44. The hollow passage 46 of the body 45 is cylindrical to allow rotation of the pin portions within the passage 46. The housing 44 is locatable in the locking space 22 which is formed in the support structure 14, and the locking pin 24 is locatable in the housing 44. The external shape of body 45 is non-circular so that the housing 44 does not rotate relative to the support structure 14. For example, in the illustrated embodiment, the body 45 is elongated at its upper surface which prevents rotation of the housing relative to the support structure 14. The housing 44 also includes a collar 52 positioned about the second end 50. The collar 52 extends laterally relative to the longitudinal axis and allows the housing 44 to only be inserted and removed from one side of the support structure 14. The locking space 22 of the support structure is enlarged at one end to include a recess 54 also formed in the support structure that extends about the one end of the locking space 22. A concavely curved surface forms the enlarged recess 54 in the support structure and the collar 52 includes a shoulder portion 56 that is convexly curved to be complementary and engage one another when the housing 44 is inserted into the support structure 14. The curved surfaces help reduce wear on the housing and the support structure 14. The collar 52 is also elongated to correspond to the shape of the external surface of the body 45. In alternative embodiments, the external surface of the housing may be any non-circular shape, such as oval, hexagonal, etc.

The pin portions 26, 28 are axially movable between a retracted (FIGS. 3 and 5) and an extended position (FIGS. 4 and 6). In the extended position at least one of the pin portions 26, 28 extend beyond at least one end of the housing 44. In the illustrated embodiment, both pin portions 26, 28 extend beyond the ends 48, 50 of the housing 44 in the extended position. In the retracted position, both ends 48, 50 are flush or within the ends of the housing 44.

As best shown in FIG. 4, when the pin portions 26, 28 extend beyond the ends 48, 50 of the housing in the extended position, a hollow interior 60 is formed between the coupling elements 32. The hollow interior 60 is formed between the coupling elements 32, the ends of the pin portions 26 28 and the corresponding ends 48, 50 of the housing 44. A seal is 76 is included between the housing 44 and the pin portions 26, 28. In particular, the seal 76 abuts a shoulder formed at the proximal ends of the coupling elements to retain the seal 76 in position relative to the pin portions 26, 28. The seal 76 prevents dirt and other material from the digging operation getting caught in the locking pin assembly 16, and in particular the hollow interior 60. This helps reduce the risk of the locking pin assembly 16 jamming during operation. In the retracted position, the coupling elements 32 interfit to form a cylinder.

A transforming mechanism causes the axial movement of one of the pin portions 26, 28 relative to the other pin portion 26, 28 between the extended and the retracted positions on rotation of at least one of the pin portions. In the illustrated embodiment, the first pin portion 26 is rotated and then both the first pin portion 26 and the second pin portion 28 rotate together. The transforming mechanism includes at least one cam and follower mechanism, but multiple cam and follower mechanisms may be provided. For example, in the illustrated embodiment, each pin portion 26, 28 includes a cam 62 and follower 64 mechanism. In alternative embodiments, the cam 62 and follower 64 mechanism may be replaced by corresponding threads, or a J-slot capable of inducing the longitudinal displacement of the pin portions.

Each cam 62 includes a cam surface 66 in the form of a helical portion that extends over the surface of the pin portion 26, 28 helically relative to the pin axis of the locking pin 24. The helical portion is in the form of a groove 66. Each pin portion 26, 28 extends from the external end 42 to an end 43 located internal the housing 44. The helical groove 66 extends about 360° from the external end 42 towards the internal end 43 of each pin portion 26, 28 and finishes in at least one retainer 69 for receiving the follower 64 when the locking pin 24 is in its extended position. The helical groove varies in pitch such that proximal each end of the groove, the groove extends radially having close to zero pitch, and between the ends of the groove, the pitch of the groove increases for a portion. The pitch of the groove 66 affects the axial displacement of the pin portions 26, 28. The groove 66 of each pin portion 26, 28 is identical such that, in position in the housing 44, the grooves 66 are mirror images of one another. In alternative embodiments, the cam surfaces may be longer or shorter distances about the respective pin portion than one another, may extend at a different pitch about the pin portion, and may also be different shapes. Different cam surfaces will affect the relative axial displacement of the pin portions. Also, the cam surfaces do not need to be identical.

The follower 64 is in the form of a projection 68 that projections that projects radially from the housing 44 into the passage 46. The follower 64 is designed to engage the cam surface as the pin portion rotates between the extended and retracted positions. The follower 68 is configured to be received in the groove 66 of the respective pin portion 26, 28.

According to FIGS. 2, 3 and 4, a first embodiment of the at least one retainer 69 is disclosed. The at least one retainer 69 retains the pin portions 26, 28 in a predetermined axial position. In the illustrated embodiment the predetermined axial position is the same as the extended position. The retainer 69 includes a keeper and a latch member which are located on respective ones of the housing 44 and an associated one of the pin portions 26, 28. Accordingly for each lock assembly, two retainers 69 are provided. The latch member is engageable with the keeper in a latched position to retain the pin portions in the predetermined axial position. In the illustrated embodiment, the keeper is formed as an end of the follower 64. The latch member is a biasing member 70 that locates relative to the keeper. In the illustrated embodiment, the end of the keeper includes a recess and the latch member locates in the recess to retain the pin portions in the predetermined axial position. In alternative embodiments, the end of the keeper is able to ride past the latch member and is retained in this position past the latch member to retain the pin portions in the predetermined axial position.

The biasing member 70 includes a rigid portion 72 and a resilient portion 74. The rigid portion is in the form of a hemispherical projection 72 that is shaped to locate in the recessed end of the keeper. It is also shaped to ride in the groove of the pin portions 26, 28. The rigid portion 72 extends into the path of the helical groove 66 so as to engage the follower and allow the follower 64 to travel past it during rotation of the pin portions 26, 28. The resilient portion 74 of the biasing member 70 compresses the biasing member 70 against its bias to follow the path of the groove 66.

In the illustrated embodiment, the resilient portion 74 comprises concentric layers of elastomeric material positioned below the rigid portion 72 in the hole. It is the resilient portion 74 which compresses upon engagement of the follower 64 with the rigid portion 72. The resilient portion 74 is able to be compressed by its expansion into a wall defining the hole. Alternatively, the resilient portion may be replaced by any resilient material such as a spring also compressible within the hole. In operation, the keeper 70 is biased so as to extend into the path 62 (either the cam surface or a part of the helical portion) of the follower 64 (i.e., the latch) during rotation of the pin portions 26, 28. As the pin portions 26, 28 rotate the follower travels in the path of the groove past the keeper to the latched position and to retain the pin portions in the predetermined position. The follower/latch 64 engages the keeper 70 to move the keeper 70 against its bias as it travels along the groove while engaging the cam surface. Once the follower 64 passes over the keeper it is in the latched position. In the latched position, the keeper 70 returns to its biased position. In its biased position, the keeper 70 engages with the latch 64 to retain the pin portions in the predetermined position. In the illustrated embodiment, the predetermined position is the extended position.

As a further alternative, the latch may include a biasing member rather than the keeper. As a further alternative, the latch may be in the form of a locking detent that includes a depressible boss. The detent has a resilient portion that is designed to engage in a dimple in the groove to retain the detent in a locking position.

Figure 5B:
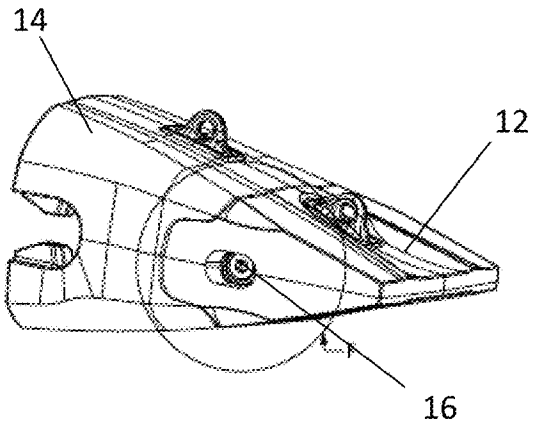
FIG. 5*b* is an isometric view of the excavation wear assembly shown in FIG. 5*a;*
Figure 5C:
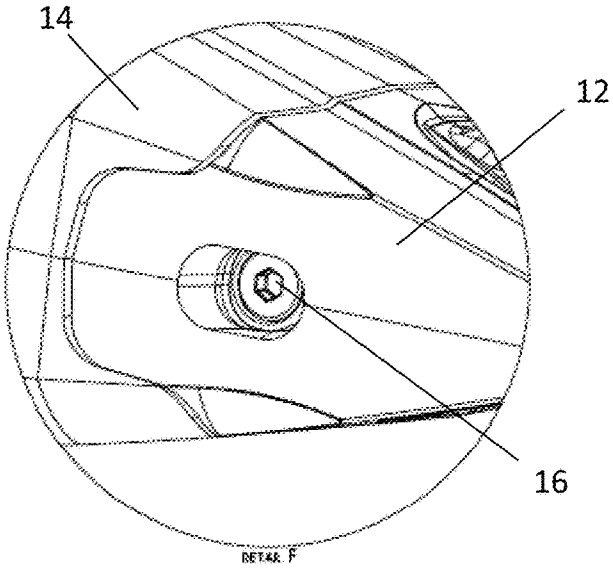
FIG. 5*c* is a close-up isometric view of the locking assembly as shown in the detail F of FIG. 5*b;*
Figure 5A:
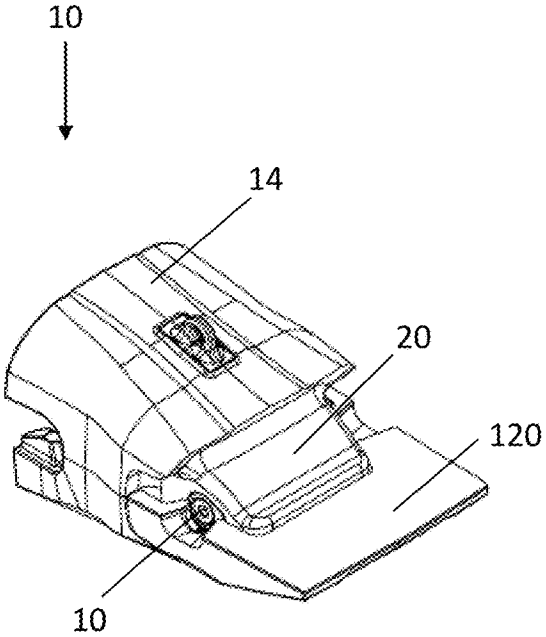
FIG. 5*a* is an isometric view of an embodiment of the excavation wear assembly as shown in FIG. 1 with a portion of an embodiment of a wear member removed and including an embodiment of the locking assembly as shown in FIG. 2 in a retracted position.
Figure 6B:
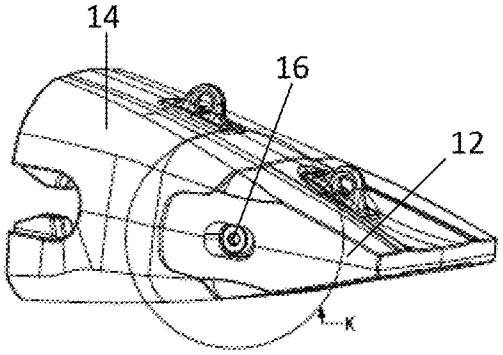
FIG. 6*b* is a perspective view of the excavation wear assembly shown in FIG. 6*a;*
Figure 6C:
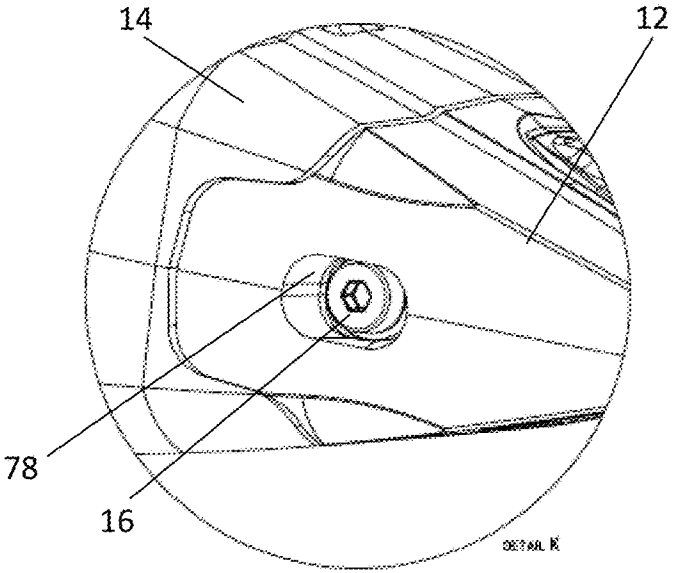
FIG. 6*c* is a close-up perspective view of the locking assembly as shown in the detail K of FIG. 6*b;*
Figure 6A:
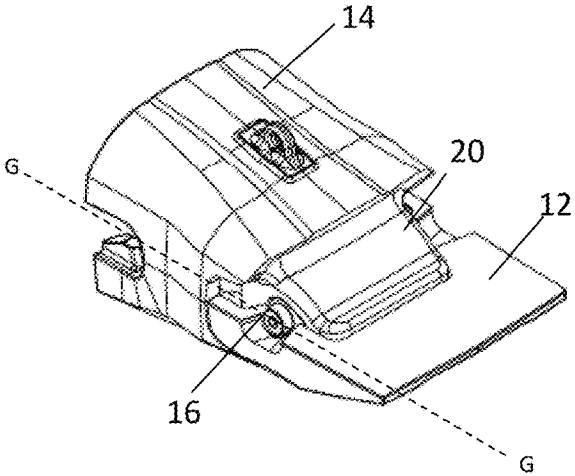
FIG. 6*a* is an isometric view of an embodiment of the excavation wear assembly as shown in FIG. 1 with a portion of an embodiment of a wear member removed and including an embodiment of the locking assembly as shown in FIG. 2 in an extended position.
Figure 6D:
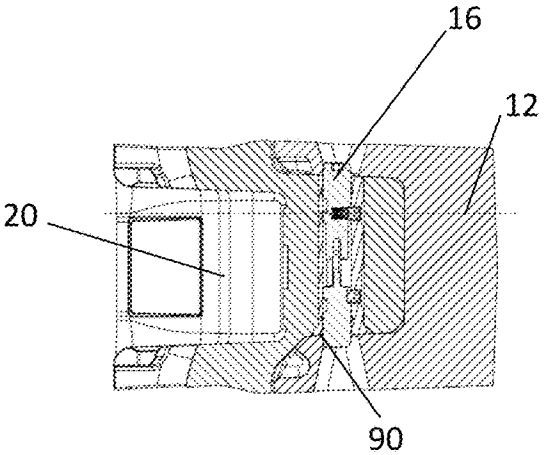
FIG. 6*d* is a cross-sectional view of the excavation wear assembly along the line G-G of FIG. 6*a;*

FIGS. 5 and 6 illustrate the excavation wear assembly 10 including the locking assembly 16 in respectively the retracted and the extended position. In operation, the locking assembly 16 is inserted into the locking space 22 of the support assembly 14 prior to the wear member 14 is retained on the support assembly 12. The wear member 14 includes a socket 18 which is received on the nose portion 20 of the support assembly. FIGS. 5*a*, 5*b* and 5*c* illustrate the wear member 14 received on the support assembly 12 including the locking assembly 16 in the retracted position. The wear member 14 and the support structure 12 extend along a longitudinal assembly axis. The locking assembly 16 is retained in a lateral position in the locking space 22 with respect to the assembly axis of the wear member 12 and the support structure 14.

The wear member 14 includes ears that extend away from the digging edge on either side of the socket. Each ear includes an aperture 78 that, in operation, is aligned with the locking space 22 of the support assembly. As a result, the tool is able to access the end 42 of the locking pin 24 to move the locking pin 24 from the retracted to the extended position and vice versa.

FIG. 6 illustrates the locking pin 24 in the extended position. In the extended position, the locking pin 24 is able to engage a wall 90 that defines the aperture 78 to retain the wear member 14 on the support structure 12. The engagement of the locking pin 24 and a portion of the wall 90 of the wear member 14 keeps the locking pin 24 in tight engagement with the locking space 22 and in particular, the retainer arrangement in tight engagement. As best shown in FIG. 6*d*, the locking pin 24 includes a bearing surface 80 which engages the wall 90 of the aperture 78. Further, there is a taper on the ends of the pin 24 which allow it to be retracted more easily if surrounded by fines.

Often there may be some wear on the relevant surfaces of the wear member 12, the support structure 14 or the locking assembly 15 after the parts have been used. When the pin 24 is fully in the extended position, the taper on the ends of the pin 24, the angle of the wall 90 of the aperture 78 of the wear member 14, the resilient nature of the at least one retainer, and the coupling 30 including interfitting coupling elements that are able to accommodate relative axial movement are able to pull the wear member 12 onto the support structure 14.

Figure 7:
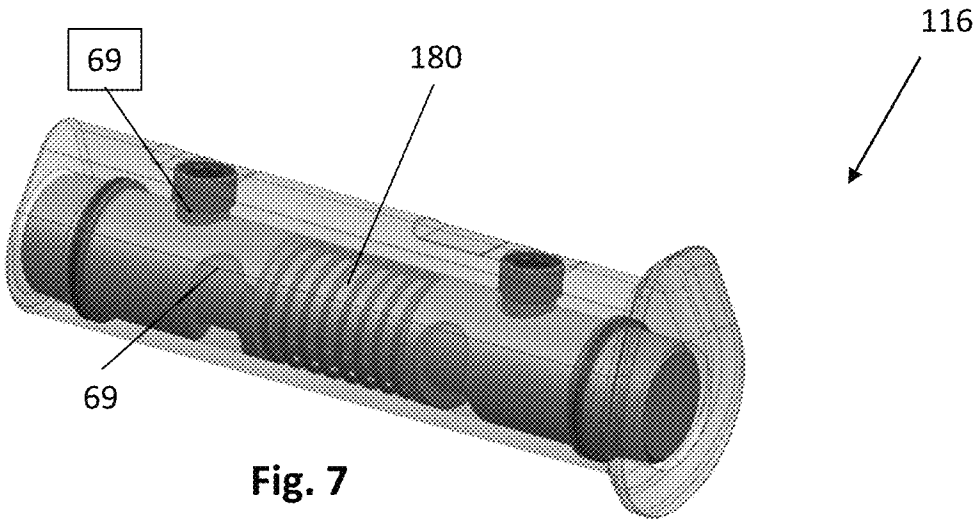
FIG. 7 is an isometric view of a second embodiment of a locking assembly in a retracted position with an embodiment of a housing shown in phantom.
Figure 8:
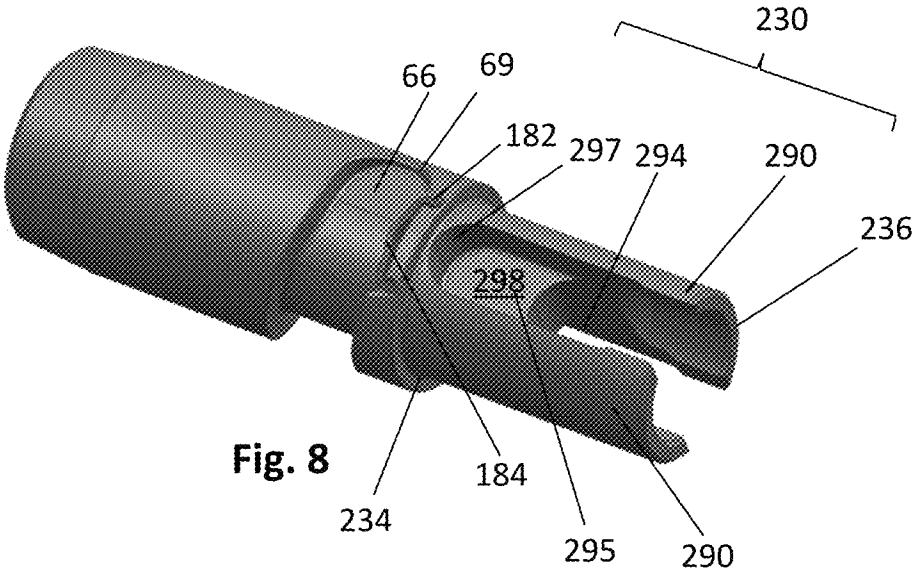
FIG. 8 is an isometric view of an embodiment of a pin portion of the locking assembly shown in FIG. 7.
Figure 9:
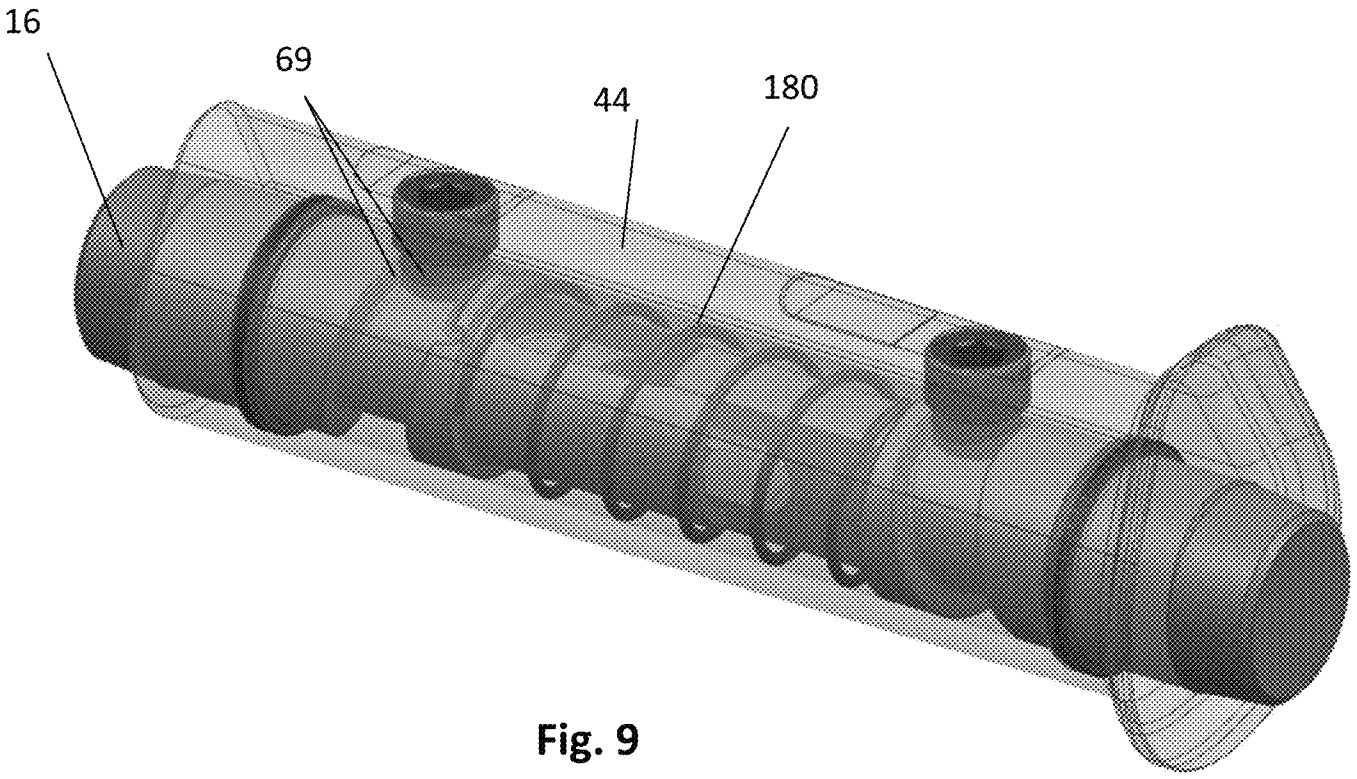
FIG. 9 is an isometric view of the locking assembly as shown in FIG. 7 in an extended position.
Figure 10:
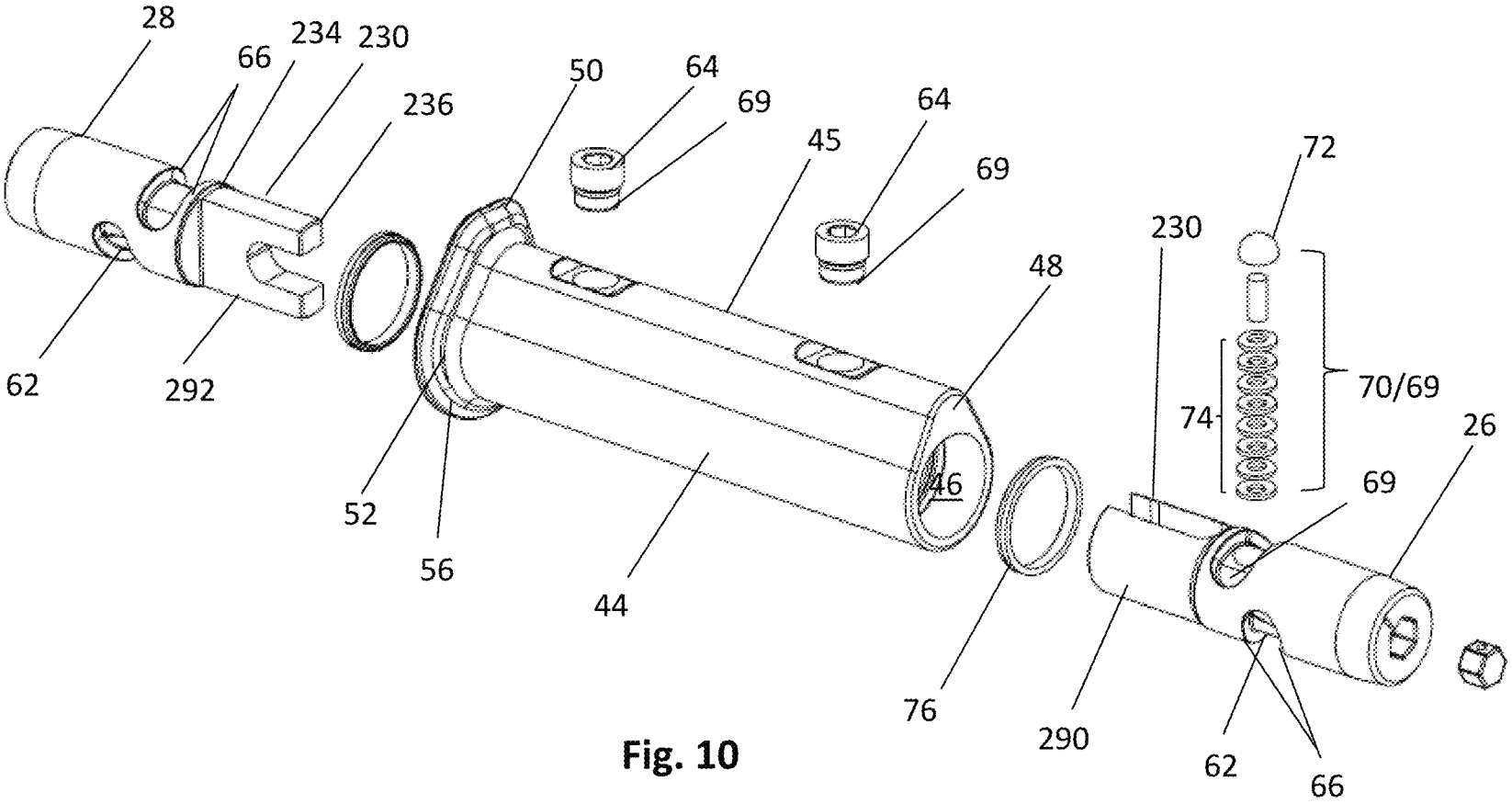
FIG. 10 is an exploded isometric view of a third embodiment of a locking assembly for excavation wear assembly.

FIGS. 7 to 9 illustrate a second embodiment of a locking assembly and a second embodiment of the at least one retainer. The same reference numerals are used for the same features.

In relation to the locking assembly 116, the primary difference is that a biasing member is included about the coupling 30. In the illustrated embodiment, the biasing member is in the form of a spring 180. The spring is shown in FIG. 7*a* under compression, and the spring is in its natural resting position when the locking assembly 116 is in the extended position. As such, when the pin portions 26, 28 are in the extended position, the spring 180 assists the at least one retainer to maintain the pin portions 26, 28 in the extended position. This force can be overcome by the manual force exerted on the tool when moving the pin portions 26, 28 to the retracted position.

In relation to the at least one retainer 169, a second embodiment is shown in FIGS. 7 to 9. Specifically, the retainer includes 169 the keeper 64 as shown in relation to the first embodiment, and a second embodiment of the latch member 170. The latch member 170 is in the form of a spring steel arrangement that, like the first embodiment, is also biased to extend into the groove 66. The spring steel arrangement 170 extends between two ends 182. Both ends 182 have a hook which engages with a shoulder 184 cut into a wall of the groove 66. The hooks 182 retain the spring steel arrangement 170 in position. The spring steel arrangement also includes a nodule 186 that projects into the groove 66 so as to engage the keeper (or the follower) 64 as the keeper 64 rides past the spring steel arrangement 170. The nodule 186 creates a gap 188 between itself and the wall defining the groove 66. When the keeper 64 engages the spring steel arrangement 170, the spring steel arrangement is sprung such that the nodule 186 moves into the gap 188 (and towards the wall) against its bias. At the same time, the ends 182 of the spring steel arrangement 170 flex and momentarily disengage with the shoulders 184.

The nodule 186 is also able to retain the keeper 64 in the latched position and the latching pin 24 in the extended position.

The spring steel arrangement 170 is not limited to being positioned in the wall of the groove 66. Alternatively, the spring steel arrangement may be positioned in the path of the groove 66 along the cam surface so as to engage the keeper.

FIGS. 10 to 12*b* illustrate a third embodiment of a locking assembly 216. The same reference numerals are used for the same features. The primary difference between the first embodiment of the locking assembly 16 and the third embodiment of the locking assembly 216 is the coupling 230. The coupling 230 functions in the same way as the coupling 30 according to the first embodiment but includes a variation in its structure which will be described in more detail below.

As also discussed above, the coupling 230 includes complementary coupling elements 290, 292 that they interfit and extend in the direction of the pin axis. The coupling elements 290, 292 are fit together in an arrangement that is similar to a tongue and groove connection. Together, the coupling elements 290, 292 form the coupling 230 which is cylindrical in shape.

The first pin portion 26 includes two coupling elements 290 (which form a portion of the coupling 230) that are angularly spaced apart by approximately 180°. In between the coupling elements 232 is a groove or channel 294 which receives the coupling elements 292 of the second pin portion 28. The channel 294 extends from the second end 236 towards the first end 234, and bifurcates into two channels 295 in the direction of the direction of the pin axis having a portion of the coupling therebetween. Each bifurcated channel 295 is shallower than the channel 294 and is defined by side walls 297 and a floor 298 which are shaped to receive the coupling elements 292 of the second pin portion.

The second pin portion 28 includes two coupling elements 292 (which form part of the coupling 230) which in use, oppose and complement the groove 294 to fit together closely. Likewise, the coupling elements 292 are also angularly spaced apart by approximately 180°. In this embodiment, the coupling elements 292 are shaped (and resemble) a U-shape including two parallel sides 296. The sides 296 of the U-shape are received in the bifurcated channels 294 and are able to abut against the side walls 297 in the retracted position.

In particular, the bearing surfaces are the parallel sides 296 rather than the angled bearing surfaces in the first embodiment. This arrangement in the third embodiment as it allows for a closer fit of the coupling elements 290, 292 inside the channel 294. This helps to prevent jamming of the pin portions during rotation and during axial movement of the pin portions relative to one another.

Further, the third embodiment of the "tongue and groove" coupling 230 is also shown in FIGS. 7-9 in the second embodiment. The channel 294 extending into the bifurcated channels is clearly visible in FIG. 8.

Figure 11A:
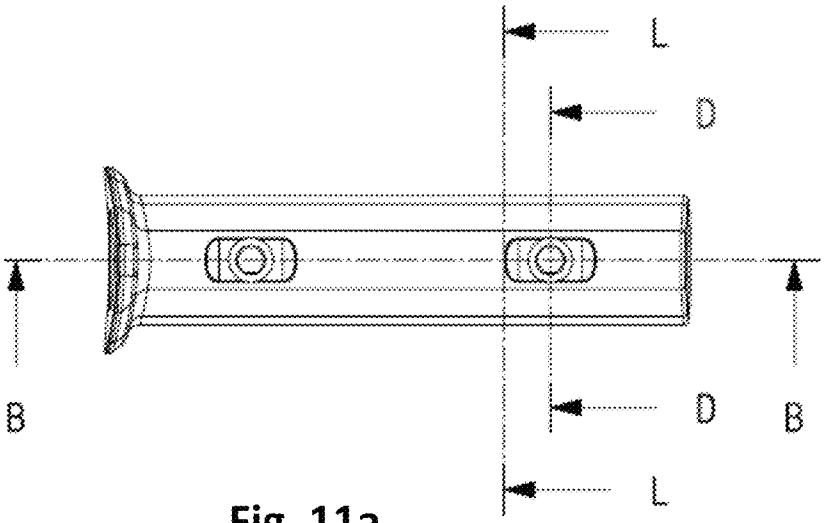
FIG. 11*a* is a side view of the locking assembly in a retracted position shown in FIG. 10.
Figure 11B:
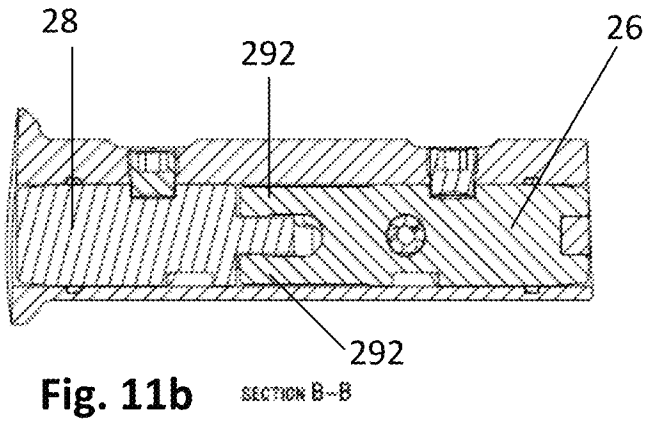
FIG. 11*b* is a cross-sectional view of the locking assembly as shown along the line B-B in FIG. 11*a;*
Figure 12A:
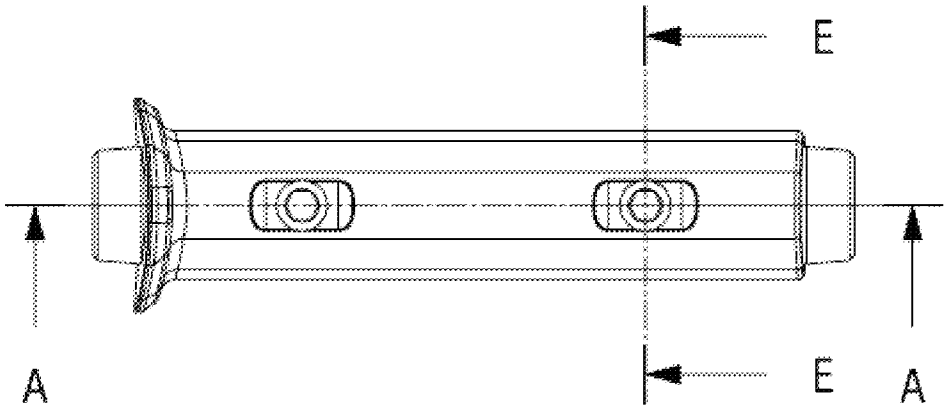
FIG. 12*a* is a side view of the locking assembly of FIG. 10 in an extended position.
Figure 12B:
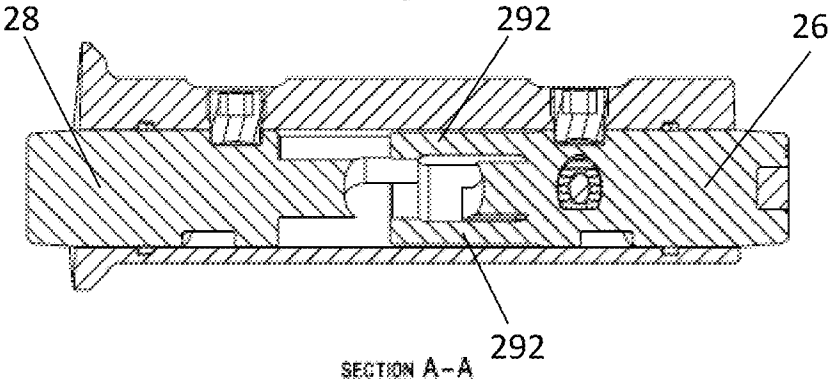
FIG. 12*b* is a cross-sectional view of the locking assembly along the line A-A of FIG. 12*a;*
Figure 13:
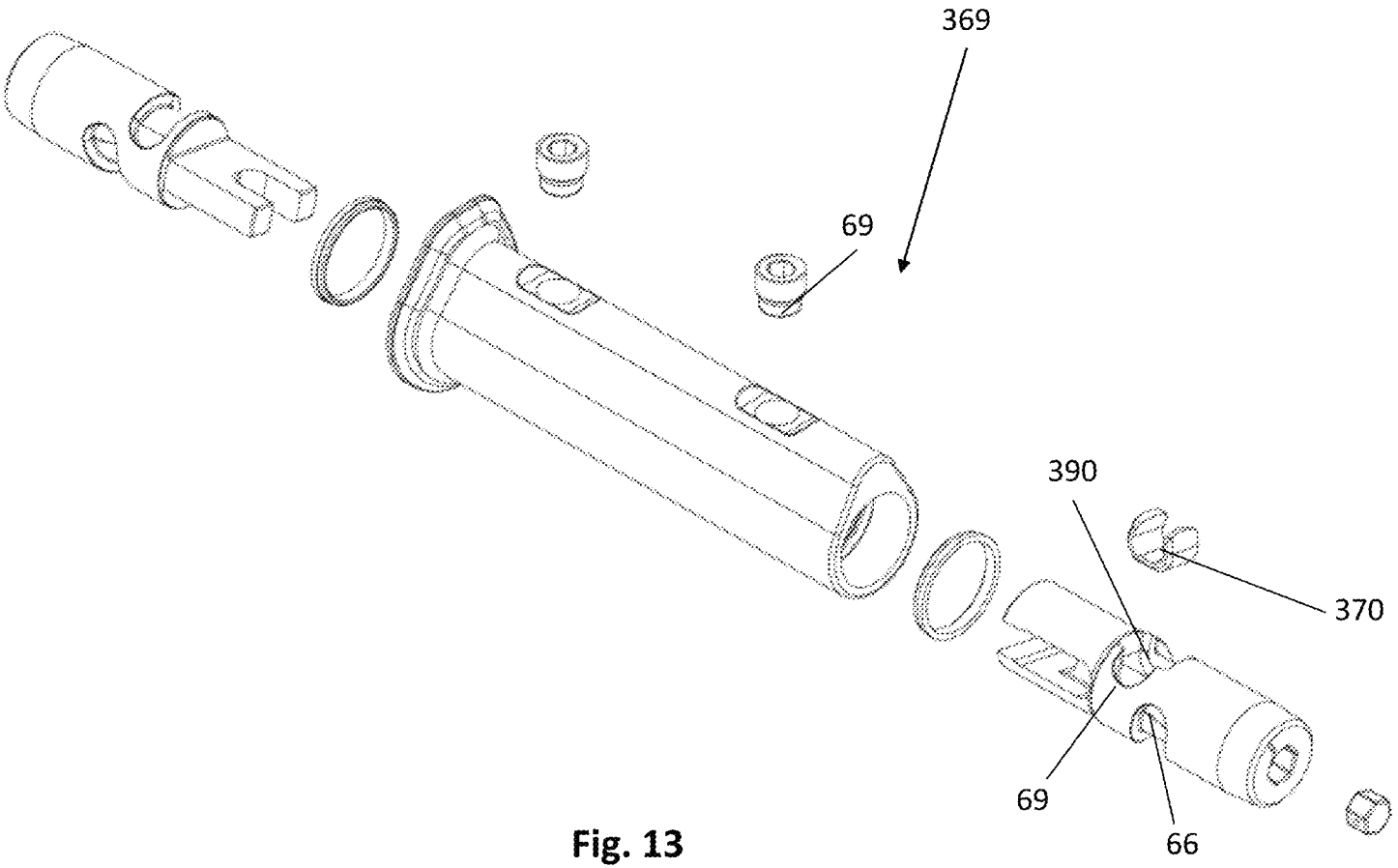
FIG. 13 is an exploded isometric view of a fourth embodiment of the locking assembly for the excavation wear assembly.
Figure 14:
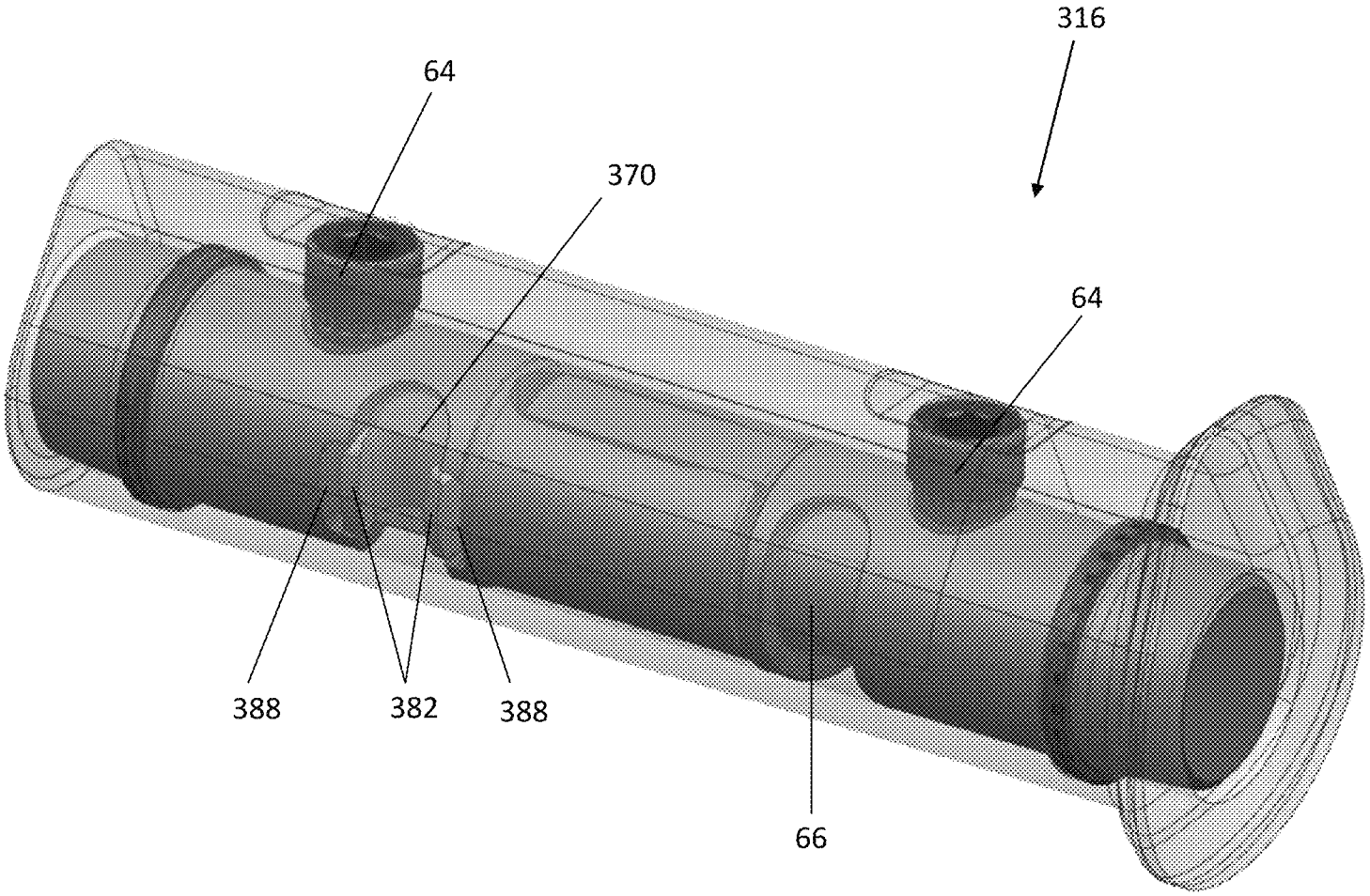
FIG. 14 is an isometric view of the locking assembly of FIG. 13 in a retracted position.
Figure 15:
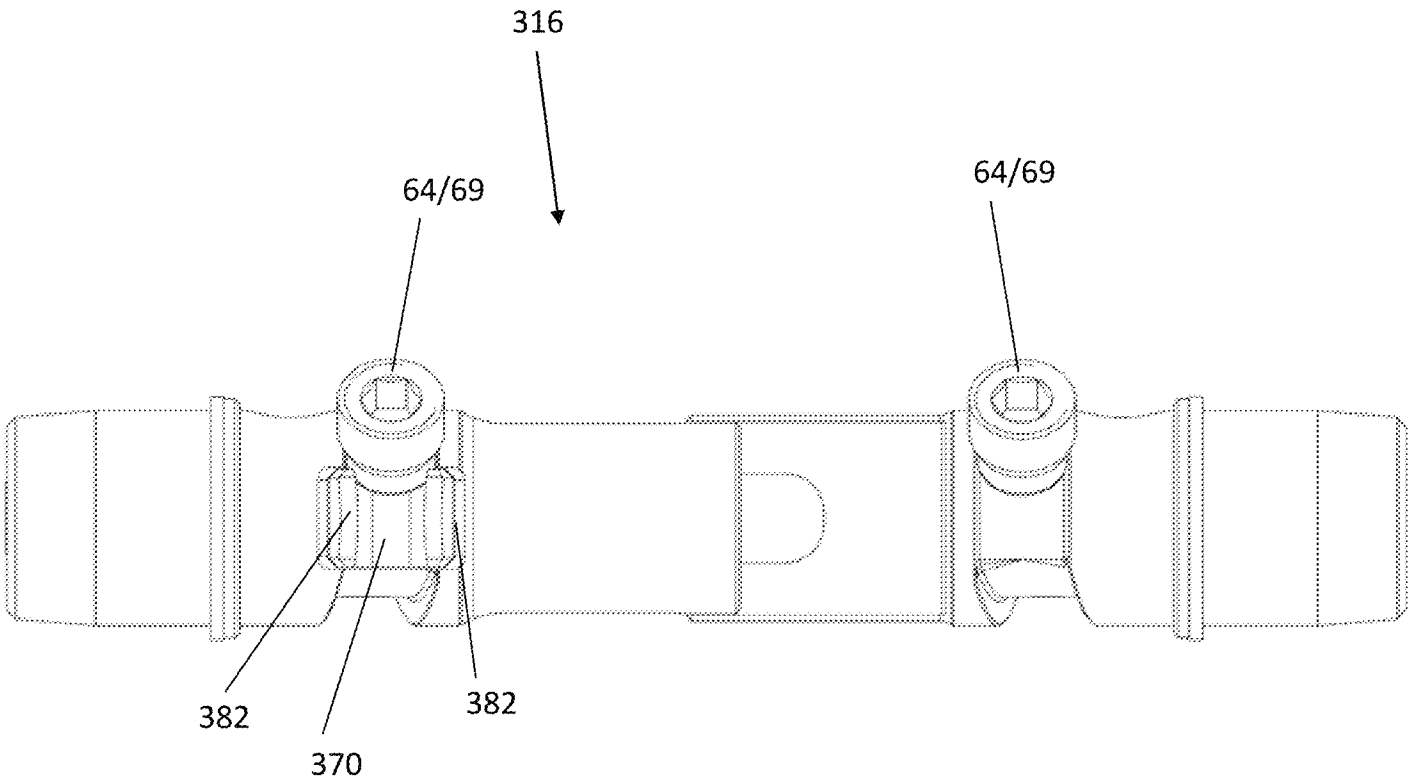
FIG. 15 is a side view of the locking assembly of FIG. 13 in an extended position.
Figure 16:
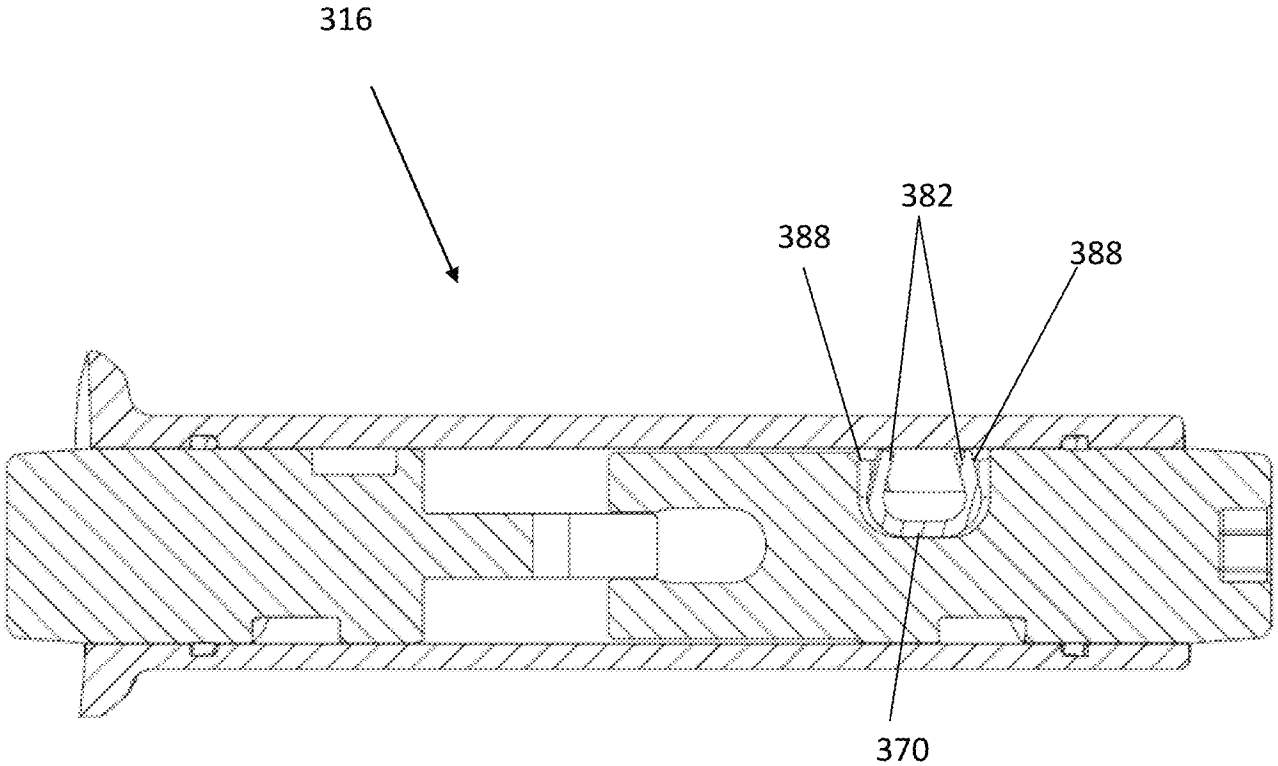
FIG. 16 is a cross-sectional view of the locking assembly of FIG. 15.

FIGS. 11*a* and 11*b* illustrate the locking assembly in the retracted position. FIGS. 12*a* and 12*b* illustrate the locking assembly in the extended position. The locking assembly according to the third embodiment is for use in a wear assembly as illustrated in FIGS. 1, 5*a* to 6*c*.

FIGS. 13 to 16 illustrated a fourth embodiment of a locking assembly 316 and a third embodiment of at least one retainer 369. The same reference numerals are used for the same features. The primary difference is in relation to the embodiment of the at least one retainer 369.

The at least one retainer 369 includes the keeper 64 as shown in relation to the other embodiments, the coupling 230 as shown in relation to the third embodiment, and a third embodiment of the latch member 370. The latch member 370 is in the form of a spring material, preferably spring steel, arrangement that is biased to extend into the groove 66. The spring steel arrangement 370 is in the form of a C-shaped spring clip. The C-shaped spring clip is received in a similarly shaped depression 390 in the path defined by the groove 66. The C-shaped spring clip includes two arms 382 that are biased towards one another to a natural or rest position. There are gaps 388 between each arm 382 in their natural rest position and the wall of the depression towards the top. As the C-shaped spring clip rides past the keeper 64, the arms 382 move against their bias away from one another. When the keeper 64 engages the C-shaped spring clip 370, the spring steel arrangement is sprung such that the arms 382 respectively move into the gaps 388 (and towards each wall).

The arms 382 retain the keeper 64 in the latched position and the latching pin 24 in the extended position. In this way, the arms 382 of the spring clip 370 block the groove 66 until a threshold force is applied to force the keeper 64 to engage the arms 382 and move the arms 382 against their bias. Subsequently, once the threshold force is reached, the keeper 64 is able to ride past (or through) the C-clip to allow the latch assembly to move to the retracted position.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A locking assembly for securing a wear member to a support structure, the locking assembly comprising:

a locking pin having a pin axis and comprising a first pin portion and a second pin portion that are spaced along the pin axis, the pin portions being interconnected through a coupling configured to allow torque to be transferred from at least one of the first or second pin portions to the other of the first or second pin portions and allow axial movement of one of the pin portions relative to the other pin portion in the direction of the pin axis; wherein the coupling is in the form of complementary coupling elements that interfit and extend in the direction of the pin axis, the coupling elements of the first and second pin portions are angularly spaced apart about the pin axis, and wherein the coupling elements of the first pin portion are arranged to be angularly offset from the coupling elements of the second pin portion so as to interfit with one another to form the coupling.

2. The locking assembly of claim 1, further comprising a housing having an internal passage which extends along a longitudinal axis between first and second ends; and the pin being locatable within the housing with at least one of the pin portions being rotatable about the longitudinal axis within the housing.

3. The locking assembly of claim 2, further comprising a transforming mechanism that causes the relative axial movement of the pin portions on rotation of at least one of the pin portions.

4. The locking assembly of claim 3, wherein the coupling causes both the first pin portion and the second pin portion to rotate together.

5. The locking assembly of claim 3, wherein the transforming mechanism comprises at least one cam and follower mechanism.

6. The locking assembly of claim 5, wherein the at least one cam includes a cam surface which is formed about at least one of the pin portions and the at least one follower is mounted to the housing and the follower remains in contact with the cam surface as the at least one pin portion rotates to cause relative axial movement of the pin portions.

7. The locking assembly of claim 2, wherein the pin portions are axially movable between an extended position and a retracted position, wherein when in the extended position, an end region of at least one of the pin portions extends beyond at least one of the ends of the housing, and when in the retracted position, the at least one of the pin portions is disposed within housing.

8. The locking assembly of claim 7, further comprising at least one retainer to retain at least one of the pin portions in a predetermined axial position.

9. The locking assembly of claim 8, wherein the retainer including a keeper, and a latch member engageable with the keeper in a latched position to retain the at least one pin portion in the predetermined axial position.

10. The locking assembly of claim 9, wherein the latch member comprises a c-shaped member having opposing arms that are caused to resiliently deform on engagement with the keeper.

11. The locking assembly of claim 10, wherein the predetermined position is the extended position.

12. The locking assembly of claim 11, wherein the latch member is biased to the latched position and the keeper forms part of the at least one follower and wherein the latch member is mounted along a portion of the cam surface such that as the at least one pin portion rotates the at least one follower remains in contact with the cam surface and moves the latch member against its bias to allow the latch member to move past, or into contact with, the keeper so that the pin portion is able to move into its predetermined axial position, whereafter the latch member is able to return to the latched position, and when in the latched position, the keeper engages with the latch member to retain the at least one pin portion in the predetermined position.

13. An excavation wear assembly for attachment of a wear member to a support structure, the excavation wear assembly comprising:

the support structure having a nose portion which is configured to receive a socket of the wear member;

a locking space formed in the support structure arranged to receive a locking assembly;

the locking assembly comprising:

a locking pin having a pin axis and comprising a first pin portion and a second pin portion that are spaced along the pin axis, the pin portions being interconnected through a coupling configured to allow torque to be transferred from at least one of the first or second pin portions to the other of the first or second pin portions and allow relative axial movement of the pin portions in the direction of the pin axis, wherein the coupling is in the form of complementary elements that interfit and extend in the direction of the pin axis, the coupling elements of the first and second pin portions are angularly spaced apart about the pin axis, and wherein the coupling elements of the first pin portion are arranged to be angularly offset from the coupling elements of the second pin portion so as to interfit with one another to form the coupling, wherein the axial movement of one of the pin portions relative to the other pin portion in the direction of the pin axis are configured to secure the wear member to the support structure.

14. The excavation wear assembly of claim 13, wherein the locking assembly further comprises a housing locatable in the locking space of the support structure, the housing having an internal passage which extends along a longitudinal axis between first and second ends; and the pin locatable within the housing, wherein at least one of the pin portions is rotatable within the housing.

15. The excavation wear assembly of claim 13, wherein the pin portions are axially movable between an extended position and a retracted position.

16. The excavation wear assembly of claim 13, the wear member having at least one retaining surface, and when the wear member is mounted to the support structure, the retaining surface is arranged to be aligned with the locking space of the support structure such that when the pin is in the extended position, the wear member is secured to the support structure, and when the pin is in the retracted position, the wear member is releasable from the support structure.

17. The excavation wear assembly of claim 16, wherein when the wear member is mounted to the support structure and when the pin is in the extended position, an end region of at least one of the pin portions extends beyond at least one of the ends of the housing and into engagement with the at least one retaining surface of the wear member to secure the wear member to the support structure, and when the pin is in the retracted position, the at least one of the pin portions is disposed within housing and disengaged from the at least one retaining surface of the wear member to allow the wear member to be removed from the support structure.

18. The excavation wear assembly of claim 13, wherein the locking assembly further comprises a transforming mechanism that causes the relative axial movement of the pin portions on rotation of at least one of the pin portions wherein, in use, the coupling causes the first pin portion and the second pin portion to rotate together.

19. The locking assembly of claim 10, wherein the c-shaped member is disposed in the pin and the keeper is disposed in the housing.

* * * * *